US010865561B2

(12) United States Patent
Schurig

(10) Patent No.: US 10,865,561 B2
(45) Date of Patent: Dec. 15, 2020

(54) DRYWALL CONSTRUCTION COMBINATION PROFILED SECTION FOR WALLS AND CEILINGS OF A HOUSE

(71) Applicant: Burkhart Schurig, Lampertswalde (DE)

(72) Inventor: Burkhart Schurig, Lampertswalde (DE)

( * ) Notice: Subject to any disclaimer, the term of this patent is extended or adjusted under 35 U.S.C. 154(b) by 0 days.

(21) Appl. No.: 16/342,729

(22) PCT Filed: Oct. 17, 2017

(86) PCT No.: PCT/DE2017/000345
§ 371 (c)(1),
(2) Date: Apr. 17, 2019

(87) PCT Pub. No.: WO2018/072771
PCT Pub. Date: Apr. 26, 2018

(65) Prior Publication Data

US 2020/0048901 A1 Feb. 13, 2020

(30) Foreign Application Priority Data

Oct. 17, 2016 (DE) ..... 10 2016 12 397

(51) Int. Cl.
*E04B 2/78* (2006.01)
*E04B 2/74* (2006.01)

(52) U.S. Cl.
CPC ..... *E04B 2/7854* (2013.01); *E04B 2/7457* (2013.01); *E04B 2/789* (2013.01); *E04B 2/7881* (2013.01)

(58) Field of Classification Search
CPC ..... E04B 2/7854; E04B 2/789; E04B 2/7881; E04B 2/7457; E04B 2/62; E04C 3/07; B21D 11/08; B21D 35/006
(Continued)

(56) References Cited

U.S. PATENT DOCUMENTS 2,085,829 A * 7/1937 Rogers ..... B21C 37/065 29/897.35
2,141,919 A * 12/1938 Kotrbaty ..... E04B 2/62 52/481.1
(Continued)

FOREIGN PATENT DOCUMENTS

AU 5340273 9/1974
AU 5340273 A 9/1974
(Continued)

OTHER PUBLICATIONS

International Search Report for PCT/DE2017/000345, dated Apr. 11, 2018, 7 pages including English translation.

*Primary Examiner* — Adriana Figueroa
(74) *Attorney, Agent, or Firm* — Smartpat PLC

(57) ABSTRACT

A wall construction system having drywall construction combination profiled sections, and a method for constructing a wall. Standard drywall construction profiled sections using sheet metal that is approximately 0.6 mm thick allow easy manual sheathing of stud walls with building panels, but lightweight sheet metal profiled sections of this type are not suitable for bearing static loads of a house. Thicker walled lightweight steel profiled sections greatly improve stability but require more costly assembly technologies needing specialists, which increases construction costs and therefore stops drywall-constructed housing from becoming more widespread. The new combination profiled sections provide for statically stable construction systems that can nevertheless be worked and sheathed simply and easily. The present drywall construction combination profiled section includes two functional sections. A statically stable section which has splayed flanges, and a section having a planar thin-walled drywall construction contact surface, acting as a sheathing section.

9 Claims, 2 Drawing Sheets

(58) Field of Classification Search
USPC ..... 72/167, 176–182
See application file for complete search history.

(56) References Cited

U.S. PATENT DOCUMENTS 2,166,096 A * 7/1939 Kotrbaty ..... E04B 1/24 52/481.1
2,664,179 A * 12/1953 Gwynne ..... E04C 3/06 403/387
3,333,390 A 8/1967 Banning
4,152,873 A * 5/1979 Burke ..... E04B 1/76 52/1
4,152,878 A * 5/1979 Balinski ..... E04B 1/941 52/481.1
4,233,833 A * 11/1980 Balinski ..... B21D 13/045 72/180
4,513,551 A * 4/1985 Gauffin ..... E04B 2/789 52/364
4,580,388 A * 4/1986 Maisch ..... E04C 3/07 52/846
4,679,370 A * 7/1987 Samuelsson ..... E04B 2/7854 52/475.1
4,881,355 A * 11/1989 Bosl ..... B21D 5/08 52/506.07
4,969,346 A * 11/1990 Bosl ..... B21D 5/08 72/177
5,179,854 A * 1/1993 Matsui ..... B21D 22/28 72/349
5,596,859 A * 1/1997 Horton ..... E04B 2/7453 52/481.1
6,092,349 A * 7/2000 Trenerry ..... E04C 3/07 52/846
7,797,908 B2 * 9/2010 Keys ..... E04C 3/086 52/846
8,001,689 B2 * 8/2011 Lindgren ..... B21D 22/02 29/897.2
8,225,581 B2 * 7/2012 Strickland ..... E04C 3/07 52/481.1
8,601,763 B2 * 12/2013 Bui ..... E04B 1/41 52/344
8,651,565 B2 * 2/2014 Zornack ..... B62D 25/025 296/205
9,004,342 B2 * 4/2015 Gallagher, Jr. ..... C22C 38/14 228/173.6
2005/0014015 A1 * 1/2005 Hauger ..... B62D 21/157 428/600
2005/0081477 A1 * 4/2005 St. Quinton ..... E04B 2/7881 52/846
2009/0133460 A1 * 5/2009 Hermann ..... E04C 3/07 72/181
2010/0281821 A1 11/2010 Frobosilo
2011/0296897 A1 * 12/2011 Knauf ..... E04B 2/789 72/379.6
2012/0192611 A1 * 8/2012 Hielscher ..... B21D 22/02 72/200
2012/0210762 A1 8/2012 Hermann et al.
2013/0283881 A1 * 10/2013 Hauger ..... B21B 37/74 72/201
2017/0254081 A1 * 9/2017 Castellucci ..... E04B 2/7457

FOREIGN PATENT DOCUMENTS

DE 102009032423 A1 1/2011
DE 102014110320 A1 * 1/2016 ..... B21C 35/023
EP 0096675 A2 12/1983
EP 0822300 A2 * 2/1998 ..... E04D 12/004
EP 2065532 A1 6/2009
FR 2631057 A1 * 11/1989 ..... E04C 3/07
GB 504405 A * 4/1939 ..... E04C 3/07
GB 1068761 A * 5/1967 ..... E04C 3/09
LU 54975 3/1969
LU 54975 A1 3/1969
WO WO-2010008296 A1 * 1/2010 ..... E04C 3/07
WO WO-2015070919 A1 * 5/2015 ..... B21D 47/01
WO WO-2015070920 A1 * 5/2015 ..... E04B 2/789
WO 2016034906 A1 3/2016
WO WO 2016034906 A1 3/2016

* cited by examiner

Fig. 1
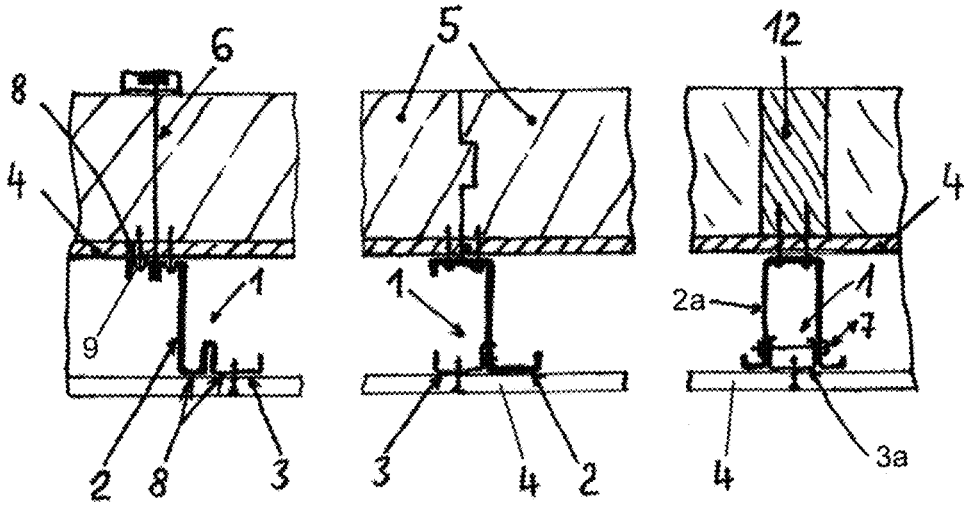
Fig. 1a Fig. 1b Fig. 1c
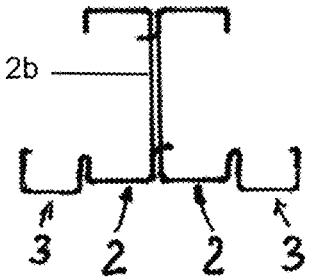
Fig. 2

DRYWALL CONSTRUCTION COMBINATION PROFILED SECTION FOR WALLS AND CEILINGS OF A HOUSE

CROSS-REFERENCE TO RELATED APPLICATIONS

This application is the U.S. national phase of PCT Application No. PCT/DE2017/000345 filed on Oct. 17, 2017, which claims priority to DE Patent Application No. 10 2016 12 397.4 filed on Oct. 17, 2016, the disclosures of which are incorporated in their entirety by reference herein.

TECHNICAL FIELD

The invention relates to a drywall construction combination profiled section for erecting statically load-bearing walls and ceilings for drywall construction houses. The substantial static loadings of the house are absorbed by the aligned perpendicular wall studs which are arranged in a grid and consist of combination profiled sections which are each enclosed at their end points in U lightweight steel profiled sections and are clad on both sides with building panels. Infilling wall bodies can be arranged between the profiled sections.

At drywall construction stud walls, the composite effect of compression-loaded studs and the extensively reinforcing cladding is significant because the building panels counteract local bulging and buckling of the metal studs, and the wall as a reinforcing plate supports the house structure.

BACKGROUND

Prior Art drywall construction systems have long been known and standardized and are primarily used for statically non-load-bearing or for only self-bearing walls and also serve for cladding statically load-bearing structures on houses. Building panels can be screwed directly and by hand to the flat contact surfaces of the lightweight steel profiled sections having wall thicknesses of approx. 0.6 to 0.7 mm using simple tools.

Structures which are capable of being statically load-bearing and which can absorb the loadings of a building are erected with more stable lightweight steel profiled sections with wall thicknesses of approx. 1.0 to 3.0 mm and more stable cladding using the same technology. However, the processing of the thick-walled drywall construction profiled sections is more difficult because of the connecting means, the static details, building approval and design safety, and therefore very few trade enterprises deal with this issue. Up to now, statically load-bearing drywall construction stud walls have previously been manufactured primarily on an industrial scale and processed as large wall elements.

The prior art is disclosed in the brochure and file "Häuser in Stahlleichtbauweise [Housings of lightweight steel design]" (documentation 560 from the Steel Information Center in Düsseldorf).

U.S. Pat. No. 3,333,390 A of 1965 discloses a thin-walled drywall construction profiled section of identical material thickness for cladding with building panels having two support sections on each side in order to increase the stability. In particular, the cladding plane is elastically separated from the load-bearing plane and nevertheless the two planes interact.

In U.S. Pat. Nos. 2,166,096 A and 2,141,919 from 1937, a material accumulation which is nevertheless intended to be flexible in terms of sound technology is sought with complicated steel profiled sections. Stable and screwable substrates are achieved using various joined additional metal sheets or intermediate elements. A flange side also provides two cladding planes one behind the other.

U.S. Pat. No. 4,233,833 A from 1980 describes a production method for local reduction in thickness of steel profiled sections which could be used in wall constructions; a specific object in wall construction does not form the basis thereof.

WO 2016/034906 A1 presents a drywall construction profiled section with improved design strength, which, by means of small-sized local formations or stampings of a sheet metal band semifinished product of identical thickness during the manufacturing process, obtains particularly stabilized profiled sections which are present particularly at folds. Over the length of the profiled section, there are flat or relatively flat cladding sections and profiled sections of relatively high strength. The profiled sections which are illustrated here as being thick-walled relate to the stamping height or depth and the initial sheet metal thickness overall. Prior to the forming, the semifinished product has an always identical homogeneous sheet metal thickness. A starting sheet which is necessarily thicker-walled for static house building then also has a large sheet metal thickness at the cladding sections, which makes cladding with building panels more difficult, and also in the case of any other thick-walled profiled section. For structural house building, the small static improvement of a semifinished product metal sheet of a thickness of approx. 0.6 mm by means of small-sized forming is insufficient.

US 2010/0281821 A1 discloses a wall stud profiled section with meandering profiled sections at the flanges and in the web of consistent sheet metal thickness. As a result, the profiled sections are more stable; there is no differentiation in cladding sections and static sections.

U.S. Pat. No. 4,152,878 A discloses a drywall construction wall stud of identical sheet metal thickness with rail-like flanges for cladding held in a form-fitting manner. In the direction of the wall plane, there is both single-layered and two-layered sheet metal sections which are arranged one behind another in the direction of the web.

SUMMARY

Problem: standard drywall construction profiled sections with a sheet metal thickness of approx. 0.6 mm permit simple manual cladding with building panels on stud walls and joists, but said lightweight drywall construction profiled sections are unsuitable for absorbing static loads of a house. Although the stability in drywall construction is significantly increased with the use of thicker-walled lightweight steel profiled sections, this necessitates more costly cladding installation technologies which increase the construction costs, require specialists as fabricators, do not permit any personal contributions and therefore reduce acceptance among builders.

Structures which are capable of being load-bearing and have very thin-walled steel profiled sections generally require a plurality of components of intermediate members or complicated expensive profiled section configurations which can make the installation outlay too costly.

For a simple manual drywall construction house building concept, lightweight, statically load-bearing lightweight steel profiled sections which can be processed by hand are therefore required, to which the structural and also space-closing claddings can be fastened on both sides in situ on a construction site using simple technology. The intention is for simple standard drywall construction to be combined with the static possibilities of steel construction.

The separation of the construction services also promises shorter construction times and lower costs. On account of safety and safeguarding aspects, statically relevant activities always require a specialized installation team which, however, may be limited only to the core task of "static body shell", i.e. primarily realizes the connection of the thick-walled static profiled sections to one another. The customary drywall construction with the extensive claddings and further subsequent construction works can be fulfilled by other construction services or by a personal contribution.

Against this background, the invention has been set the object of additionally providing statically stable steel sheet metal profiled sections with drywall construction connecting surfaces for simple cladding with building panels, permitting manual installation at the building site and separating the services of "static body shell" from "standard drywall construction" in terms of technology and time. The structural stability or at least the installation safety of said walls are also intended to be made possible without inner cladding. The dry interior construction therefore only takes place subsequently after all of the installations are finished.

The invention achieves these objects as indicated in the characterizing features of patent claims 1 to 8.

The drywall construction combination profiled section consisting of galvanized steel sheet with its two functional sections represent high stability and simple processing. The thick-walled profiled section with the two flanges and the web therefore primarily fulfills the static function of the wall stud, while the thin-walled profiled section of a thickness of approx. 0.6 mm can be clad using standard connecting means.

By means of the variation in respect of profiled section spacing, profiled section geometry, material thickness and steel quality or by means of the variation in the cladding, the stability of the drywall construction wall can be adapted to the requirements. The static determination of thicker-walled steel profiled sections permits a recognized dimensioning of structures and, in contrast thereto, saves costly individual testing of very thin-walled steel sheet metal profiled sections of the drywall construction that are used repeatedly or in interlaced form.

In order to increase the capability of load bearing, use is made of semifinished products consisting of different steel sheet metal thicknesses and optionally steel qualities in the manufacturing of the profiled sections. Although semifinished product sheet metal bands of different thickness within the band are theoretically known in the form of tailor welded coils or tailor rolled coils for roll forming, they are not available in practice. For example, the longitudinally welded sheet metal band can have a sheet metal thickness of 0.6 mm and customary yield strength for the drywall construction contact surface and a sheet metal thickness of 1.6 mm with a particularly high yield strength for the static profiled section.

The manufacturing method of "linear flow splitting" can also split the cross section of a thick metal sheet into partial surfaces of differing thickness on the narrow side. A steel sheet metal web can therefore be split into two drywall construction contact surfaces of unequal thickness and can subsequently be folded.

Since the statically load-bearing drywall construction profiles have continuous patterns of holes on the building panel contact surface, the non-specialized fabricator is provided with a possibility of also using simple connecting means, such as screws, to fasten any desired claddings from the room inner side to the stud outer side, and this type of fastening also meets the highest structural requirements.

Specifically in the case of lightweight structures for living purposes, particular endeavors are necessary to provide high sound and fire protection. The combination profiled sections according to the invention provide connections both for stable outer claddings, intermediate panels and decoupled inner claddings and component layers substantially decoupled in terms of structure-borne sound.

If the type of façade covering requires local structural fastenings, the latter are then already preassembled as façade holders or as façade support strips on the stud profiled section during the process of installing the wall. A multiplicity of profiled section shapes and reinforcing variants can carry out the abovementioned tasks, as, for example, FIGS. 1 to 3 show.

The drywall construction wall construction system according to the invention with the combination profiled section simplifies the processing of static drywall construction systems and, for the ambitious drywall constructor, also opens up static house building as a line of business and reduces the body shell costs. Two fitters can within a short time erect highly insulated, statically stable outer walls with very little use of material, with a desired standard in terms of the physical construction and with few working steps. The drywall construction combination profiled sections are equally suitable also for ceilings and roofs. The surfaces of dry body shell, installations, window constructions, dry construction and façade construction can act independently of one another.

BRIEF DESCRIPTION OF THE DRAWINGS

FIG. 1 is the horizontal cross sections through a drywall construction wall with three different drywall construction combination profiled sections; 1*a*, 1*b*, and 1*c;*

FIG. 2 is the cross section of a drywall construction combination profiled section for ceilings or roofs without the claddings on both sides;

DETAILED DESCRIPTION

Figure 3A:
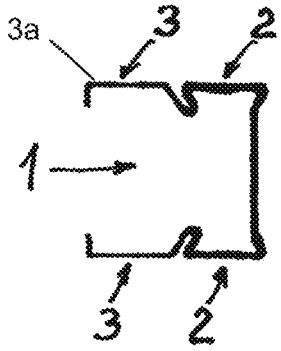
FIGS. 3*a*-3*c* are cross sections of the combination profiled sections without claddings.

FIG. 1: the exemplary embodiment shows horizontal cross sections through a drywall construction wall with three different drywall construction combination profiled sections (1) which are set vertically and anchored as wall studs in horizontal U foot and U head profiled sections. The outer building panel (4) serves primarily for structural wall reinforcement and consists of an OSB panel coated with insulating materials and is part of a wall body (5) which is screwed from the inside to the static section (2) of the drywall construction combination profiled sections (1).

The wall bodies (5) with the dimensions of approx. 60 cm×250 cm and peripheral tongue and groove system are plugged together in a horizontal offset with the profiled sections overlapping and are screwed to the static sections (2) of the wall inner side. In the area of the story ceiling, a wall body (5) overlaps both the studs of the ground floor and of the first floor. The outer insulating layer also serves as a plaster base for the façade.

In the construction process, first of all all of the drywall construction combination profiled sections (1) are produced at their static sections (2) with the U foot and U head profiled sections in the form of a house framework by specialized fabricators and structurally connected to one another. All of the connecting points are accessible on all sides with specialized tools of the trade. Subsequently, other surfaces take on the claddings of the combination profiled sections. Only after the room-interior installation of installations and sound protection mats are building panels (4) as interior finish screwed at a subsequent time to the thin-walled cladding sections (3). The same construction can in principle also be used for ceiling and roof structures.

FIG. 1*a*: in the static section (2), the drywall construction combination profiled section is a modified Z profile composed of steel sheet with a room-side folding having the thickness of 1.6 mm and with a drywall construction contact surface (8) additionally integrally formed on the room side as a cladding section (3) composed of steel sheet of a thickness of 0.65 mm. The folding of the static profiled section stabilizes the flange and reduces the profiled section width. The sheet metal band semifinished product is a longitudinally welded sheet metal strip of different thickness (tailor welded coil), wherein the static section has a yield strength of approx. 600 N/mm$^2$.

In the static section of the combination profiled section (1), the outer drywall construction contact surface is provided throughout with a pattern of holes, and therefore the screw connections to the wall bodies (5) can take place there from the inside at selected perforations. All of the perforations can be achieved non-critically using tools of the trade.

On the same drywall construction contact surface, there are relatively large perforations at a greater spacing, into which façade holders or roof holders (6) are inserted, optionally from the inside, and anchored. Said holders take over the introduction of load from local façade loads or roof loads into the static section of the drywall construction profiled section. Said façade holders (6) having any desired structure are anchored from the inside to the drywall construction profiled section during the process of constructing the wall.

In the static section (2), the combination profiled section of FIG. 1*b* is a Z profile composed of steel sheet having the thickness of 2.5 mm, which is connected to a story-high, separate, thin-walled drywall construction profiled section in a form-fitting manner as a cladding section (3). Deflected local tabs of the thin-walled profiled cladding section (3) engage in suitable punched-out portions of the Z profiled section web and are hooked therein. On account of the accessibility, the cladding section (3) is only hooked in after the outer reinforcing cladding (4) is fastened to the static profile. In particular in the event of large differences in thickness of the two combination profiled sections, separate profiled section parts are necessary for manufacturing requirements.

The combination profiled section (1) of FIG. 1*c* is also composed of two separate profiled sections; of a static hat profiled section (2*a*) and a thin-walled C profiled section (3*a*) which is inserted in a flush and form-fitting manner therein and the two parts of which are fixed by a plurality of screw bolts (7). Here too, the C profiled section is only fitted retrospectively after the outer cladding (4) is attached.

Between the outer cladding (4) of the stud and the façade surface, a façade support strip (12) is applied perpendicularly to the static section (2) and fastened from the inside. Said façade support strip is a high-strength insulating material strip which, at the grid spacing of the wall studs, absorbs the façade forces and introduces the latter into the static drywall construction combination profiled section. Suspended façades are primarily supported thereon and can also be fastened thereto.

FIG. 2 shows the cross section of a drywall construction combination profiled section for ceilings or roofs without the claddings on both sides. Here, two combination profiled sections with a statically load-bearing C profile (2*b*) which are each produced from a tailored coil are connected in a form-fitting manner. The thin-walled cladding sections (3) are in each case only integrally formed on the lower flanges or static sections and belong to the same sheet metal band semifinished product of the combination profiled section. The thin-walled cladding section (3) is located in the wall plane parallel next to the static section (2) of the individual combination profiled section and in a drywall construction contact surface offset in parallel.

FIG. 3: the shown cross sections of the combination profiled sections (1) are illustrated without claddings and consist of profiled section flange sections of different material thicknesses. The combination profiled section of FIG. 3*a* includes sections with different thickness. A thicker static section (2) and a thinner cladding section (3) are roll-formed from only one steel band semifinished product. The thin-walled cladding sections have been produced by additional rolling (tailor rolled coil) or the sections have been produced by welding together sheet metal strips of differing thickness (tailor welded coil). The edge zones (3*a*) which are thin-walled on both sides have a thickness of 0.65 mm, and the static load-bearing C profiled section (2*b*) has a thickness of 1.6 mm. The contact surfaces of the drywall construction cladding for both profiled sections are located on both sides in the same wall plane, and therefore easy connection to the U foot and U head profiled sections is provided. For considerations in terms of sound, only the cladding sections (3) can also lie in an offset wall plane.

Figure 3B:
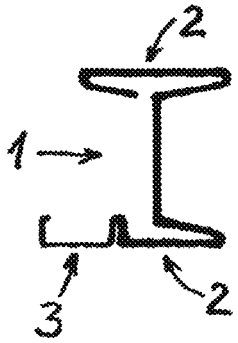

FIG. 3*b*: the drywall construction combination profiled section (1) having a static I structure has only one integrally formed thin-walled cladding section (3) as part of the drywall construction contact surface (8) on a flange side.

Figure 3C:
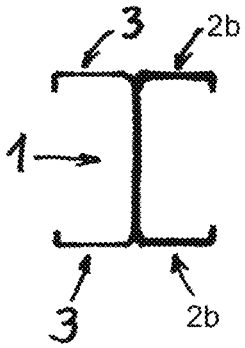

FIG. 3*c* shows a drywall construction combination profiled section (1) having drywall construction connecting surfaces of differing thickness in each case on both sides, said drywall construction combination profiled section being produced by the linear flow splitting manufacturing method. This sheet metal forming process includes linear flow splitting a steel sheet band having a thickness of, for example, 3 mm on both sides into a sheet metal static section (2) having of a thickness of 2.3 mm and a cladding section (3) having a thickness of 0.7 mm. The split sheet metal sections are subsequently profiled.

All of the combination profiled sections of FIG. 4 are produced from an identically thick galvanized steel sheet band with a thickness of 0.6 mm to 0.7 mm by roll forming, with the static profiled section flanges of which being reinforced by material concentrations. Only the cross sections of the drywall construction combination profiled sections are illustrated.

Figure 4A:
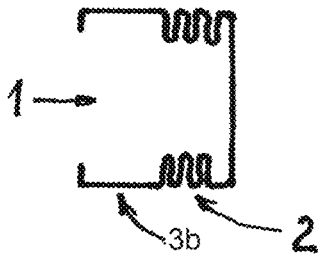
FIGS. 4*a*-4*c* are cross sections of various profile sections.

FIG. 4*a* shows a C-like profiled section having thin-walled connecting surfaces (3*b*) on both sides at the edge zones of the flanges. Directly next to the web, the load-bearing flanges are tightly folded in a meandering form in order to significantly increase the steel portion in said area and therefore the load-bearing capability of the static section (2) of the combination profiled section (1) with the same material thickness. As a result of the intrinsic stability of the flange areas, the thin-walled profiled section web which is reinforced with beads is sufficient. The profiled section height is, for example, 125 mm in cross section and the height of the meanders is approx. 25 mm. The folded meandering sections adapt with particularly little stress to uneven support.

Figure 4B:
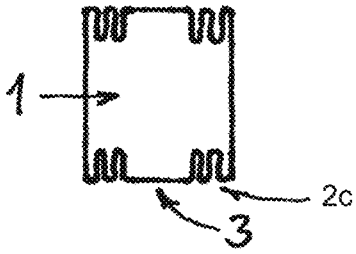

The combination profiled section (1) of FIG. 4*b* with flanges (2*c*) folded in a meandering form and in each case a central cladding section (3) is, as a hollow profiled section, particularly stable in terms of buckling and is particularly suitable for load-bearing inner walls. All four outer surfaces can be clad. During the manufacturing, the free profiled section flanks are welded, or two halves are joined.

Figure 4C:
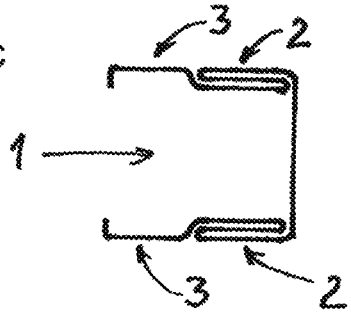

The combination profiled section (1) of FIG. 4*c* has material concentrations at the statically load-bearing flanges by means of blocked multiple layers of a sheet metal band parallel to the drywall construction contact surface in order to act as a static section (2) of the combination profiled section. For easier installation of the building panels, the cladding sections (3) are located directly laterally next thereto, optionally in in each case a different wall plane.

LIST OF REFERENCE SIGNS

1—Drywall construction combination profiled section
2—Static section
3—Cladding section
4—Building panel
5—Wall body
6—Façade holder
7—Screw bolt
8—Drywall construction contact surface
9—Pre-punched perforations
12—Façade support strip

The invention claimed is:

1. A drywall construction profile for walls and ceilings of a building, comprising:

two flanges arranged laterally offset from one another, each of the two flanges providing a flat drywall contact surface configured to attach building panels thereto; and at least one web connecting the two flanges, wherein each of the two flanges includes a static section made of a first material having a thickness of at least 1.0 mm, and wherein at least one of the two flanges includes a cladding section made of a second material having a thickness of less than 0.75 mm, and wherein the first material and the second material are different.

2. The drywall construction profile as in claim 1, wherein the first material is a first steel and the second material is a second steel, the first steel having a yield strength which is greater than a yield strength of the second steel.

3. The drywall construction profile as in claim 1, wherein the static section and the cladding section are integrally formed from a tailor welded sheet metal semifinished product.

4. The drywall construction profile as in claim 1, wherein the cladding section and the static section are arranged parallel next to each other.

5. The drywall construction profile as in claim 1, wherein the cladding section and the static section are offset parallel to each other.

6. The drywall construction profile as in claim 1, wherein the static section of one of the two flanges includes pre-punched perforations in a plurality of rows in an area forming the flat drywall contact surface.

7. A load-bearing wall, comprising a plurality of drywall construction profiles as in claim 1, each carrying a structural load.

8. A drywall construction profile for walls and ceilings of a building, comprising:

two flanges arranged laterally offset from one another, each of the two flanges providing a flat drywall contact surface configured to attach building panels thereto; and at least one web connecting the two flanges, wherein each of the two flanges includes a static section having a thickness of at least 1.0 mm, and wherein at least one of the two flanges includes a cladding section having a thickness of less than 0.75 mm, and wherein the static section and the cladding section are separately formed sheet metal parts having two different material thicknesses.

9. The drywall construction profile as in claim 8, wherein the static section and the cladding section are connected in a form-fitting manner by local sheet metal deflection.

* * * * *